United States Patent [19]

Martin

[11] 4,394,118

[45] Jul. 19, 1983

[54] METHOD AND ARRANGEMENT FOR REDUCING $NO_x$ EMISSIONS FROM FURNACES

[76] Inventor: Johannes J. Martin, Leopoldstrasse 248, 8000 München 40, Fed. Rep. of Germany

[21] Appl. No.: 281,309

[22] Filed: Jul. 8, 1981

[30] Foreign Application Priority Data

Jul. 8, 1980 [DE] Fed. Rep. of Germany ..... 3025851

[51] Int. Cl.[2] ..... F23J 7/00

[52] U.S. Cl. ..... 431/4; 431/190; 110/215

[58] Field of Search ..... 431/4, 190; 110/188, 110/190, 291, 215

[56] References Cited

U.S. PATENT DOCUMENTS

| | | | |
|---|---|---|---|
| 1,159,862 | 11/1915 | Ostergren | 110/291 |
| 1,291,175 | 1/1919 | Sargent et al. | 110/215 |
| 3,183,864 | 5/1965 | Stengel | 431/4 |
| 3,456,606 | 7/1969 | Withorn | 110/215 |
| 3,530,807 | 9/1970 | Zalman | 110/215 |
| 3,785,304 | 1/1974 | Stookey | 110/190 |
| 4,089,639 | 5/1978 | Reed et al. | 431/4 |
| 4,144,015 | 3/1979 | Berthiaume | 431/4 |
| 4,162,140 | 7/1979 | Reed | 431/284 |
| 4,173,450 | 11/1979 | Schrank | 431/4 |
| 4,244,684 | 1/1981 | Sperry et al. | 431/4 |

*Primary Examiner*—Henry C. Yuen

*Attorney, Agent, or Firm*—Kontler, Grimes & Battersby

[57] ABSTRACT

A combustion apparatus has a combustion chamber which is divided into combustion zones respectively communicating with individual mixing zones in a mixing chamber. Combustion air enters the mixing zones and then flows into the combustion zones. The concentration of $NO_x$ in the combustion products of each of the combustion zones is measured and water vapor is fed into each mixing zone in an amount which depends upon the $NO_x$ concentration for the corresponding combustion zone. The amount of water vapor fed into a mixing zone is such as to maintain the combustion temperature below a value at which substantial quantities of $NO_x$ are formed. The water vapor is fed into the mixing zones generally countercurrent to the combustion air entering the combustion zones and the water vapor and combustion air flow into the combustion zones together.

2 Claims, 2 Drawing Figures

23
29
20
20'
20"
10
11
12
13
14
15
16
17
18
18'
18"
18'''
18''''
2
2'
2"
2'''
3
4
5
6
7
8
9
21
22
22'
22"
22'''
24
25
26
28
II

METHOD AND ARRANGEMENT FOR REDUCING $NO_x$ EMISSIONS FROM FURNACES

BACKGROUND OF THE INVENTION

The invention relates generally to combustion apparatus.

More particularly, the invention relates to a method and arrangement for reducing $NO_x$ emissions from combustion apparatus, especially large furnaces.

Steadily increasing environmental pollution has directed attention to the problem of minimizing nitrogen oxide or $NO_x$ emissions from large furnaces. The formation of $NO_x$ depends essentially on the combustion temperature and on the fuel which is used. At high temperatures, $NO_x$ formation is increasingly favored as the dwell time and excess of air increase.

It is known that $NO_x$ emissions can be reduced by maintaining the temperature in the combustion chamber, that is, in the immediate vicinity of the combustion taking place in the combustion chamber, below a specific value. This is based upon the known fact that $NO_x$ formation increases markedly above a predetermined, critical temperature. Accordingly, it is attempted to maintain the combustion temperature below this critical temperature. This may be achieved by recirculating the waste gases or increasing the excess of air.

Both of these procedures possess the substantial disadvantage that the quantity of gas to be conveyed and cleaned increases markedly. This makes it necessary to install a much larger electrostatic or dust filter, as well as fans of higher capacity, which leads to a corresponding increase in energy consumption. Recirculation of waste gases also results in a further disadvantage. Thus, special pipes are required for recirculation of the waste gases. Due to the unavoidable temperature variations which occur, these pipes frequently tend to develop leaks. Since an overpressure is required to blow the waste gases into the combustion chamber, such leaks will permit waste gases to escape into the boiler house.

OBJECTS AND SUMMARY OF THE INVENTION

It is an object of the invention to provide a method and arrangement for reducing $NO_x$ emissions from combustion chambers without an undue increase in energy consumption.

Another object of the invention is to provide a method and arrangement for reducing $NO_x$ emissions from combustion chambers without causing the escape of harmful quantities of other dangerous gases.

An additional object of the invention is to reduce the combustion temperature to below a predetermined value above which $NO_x$ formation is very strong and thereby decrease $NO_x$ emissions. This is to be achieved without requiring the installation of unduly large dust filters and fans for the waste gases to be removed from the combustion chamber.

The preceding objects, and others which will become apparent as the description proceeds, are achieved by the invention.

According to the invention, a method of reducing $NO_x$ emissions from combustion chambers involves establishing combustion in such a chamber and admitting water vapor into each of a pluralty of combustion zones of the chamber in an amount depending upon the $NO_x$ concentration of the gases in the respectve zone.

The use of water vapor as an inert medium for reducing the combustion temperature in the combustion chamber leads to the substantial advantage that very large quantities of heat can be withdrawn using relatively small amounts of gas. This is due to the very high specific heat of water vapor. Thus, the combustion temperature can be reduced to a value at which only very small quantities of $NO_x$ are formed. Lowering of the combustion temperature is enhanced by the ability of water vapor to absorb radiant energy from its surroundings. This ability results from the fact that water vapor is a triatomic gas. Furthermore, the handling of water vapor is much simpler than the handling of recirculating waste gases since the pipes required for the water vapor have a much smaller cross-section than those for the waste gases. This also makes it possible to use smaller valves so that, from a structural point of view, substantial savings in capital costs may be realized. In addition, since the water vapor causes only a relatively small increase in the volume of the waste gases, it is unnecessary in most cases to increase the size of the dust filter which was installed to handle the original quantities of waste gases. In fact, the moistening of the waste gases by the water vapor has the known effect of increasing the efficiency of the electrostatic dust filter. Also, it is likewise unnecessary in most cases to provide larger fans for withdrawing the waste gases from the combustion chamber.

According to a preferred embodiment of the invention, the water vapor is supplied to the combustion chamber together with the combustion air.

It is advantageous for the entire length of the combustion region to be divided into combustion zones and for the water vapor to be supplied to each of these zones in dependence upon the $NO_x$ concentration.

In accordance with another embodiment of the invention, the water vapor includes or consists of waste steam which is obtained from a closed system having a boiler which is connected with the combustion chamber. This is a particularly economical manner of reducing the $NO_x$ emissions. The waste steam, which is available at a pressure of 1.5 to 2.0 bars and has a saturation temperature of approximately 110° to 120° C., is especially well-suited for admixture with the combustion air to serve as an inert medium for reduction of the combustion temperature.

The water vapor and combustion air may be mixed in a mixing chamber having mixing zones which communicate with respective ones of the combustion zones. Particularly uniform mixing of the water vapor and combustion air may be achieved by causing the water vapor and combustion air to flow generally countercurrent to one another in at least a portion of the respective mixing zones. The mixing zones may be located below the combustion chamber, or below a grate provided in the combustion chamber, so that the combustion air flows upwardly to enter the combustion chamber.

It may be advisable to preheat the combustion air in order to avoid condensation.

A combustion apparatus according to the invention comprises a combustion chamber and supplying means for individually supplying water vapor to respective combustion zones of the chamber.

One embodiment of the combustion apparatus includes a grate in the combustion chamber and a mixing chamber below the grate. The mixing chamber is divided into separate, forced-draft mixing zones, that is, mixing zones arranged for the forced admission of combustion air therein. A water vapor supply conduit is provided in each of the mixing zones and extends transverse to the longitudinal direction of the grate. Each conduit has outlet openings or nozzles which are positioned so as to permit the water vapor to enter the respective mixing zone in substantially countercurrent flow to the combustion air traveling towards the grate.

In certain known combustion apparatus, e.g. furnaces, the combustion air enters via openings in a side wall of the apparatus. When the invention is applied to such apparatus, the water vapor and combustion air in the mixing zones will undergo a mixed flow relative to one another in that the flow will be partly countercurrent and partly transverse.

In order to prevent blockage of the outlet openings or nozzles of the water vapor supply conduits, another embodiment of the combustion apparatus of the invention provides for each of the water vapor supply conduits to be protected from the grate by a cover. The covers are advantageously constituted by the support structure for the grate. If the conduits were not so protected, fine ashes falling through the grate could deposit on the conduits and block the outlet openings or nozzles.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
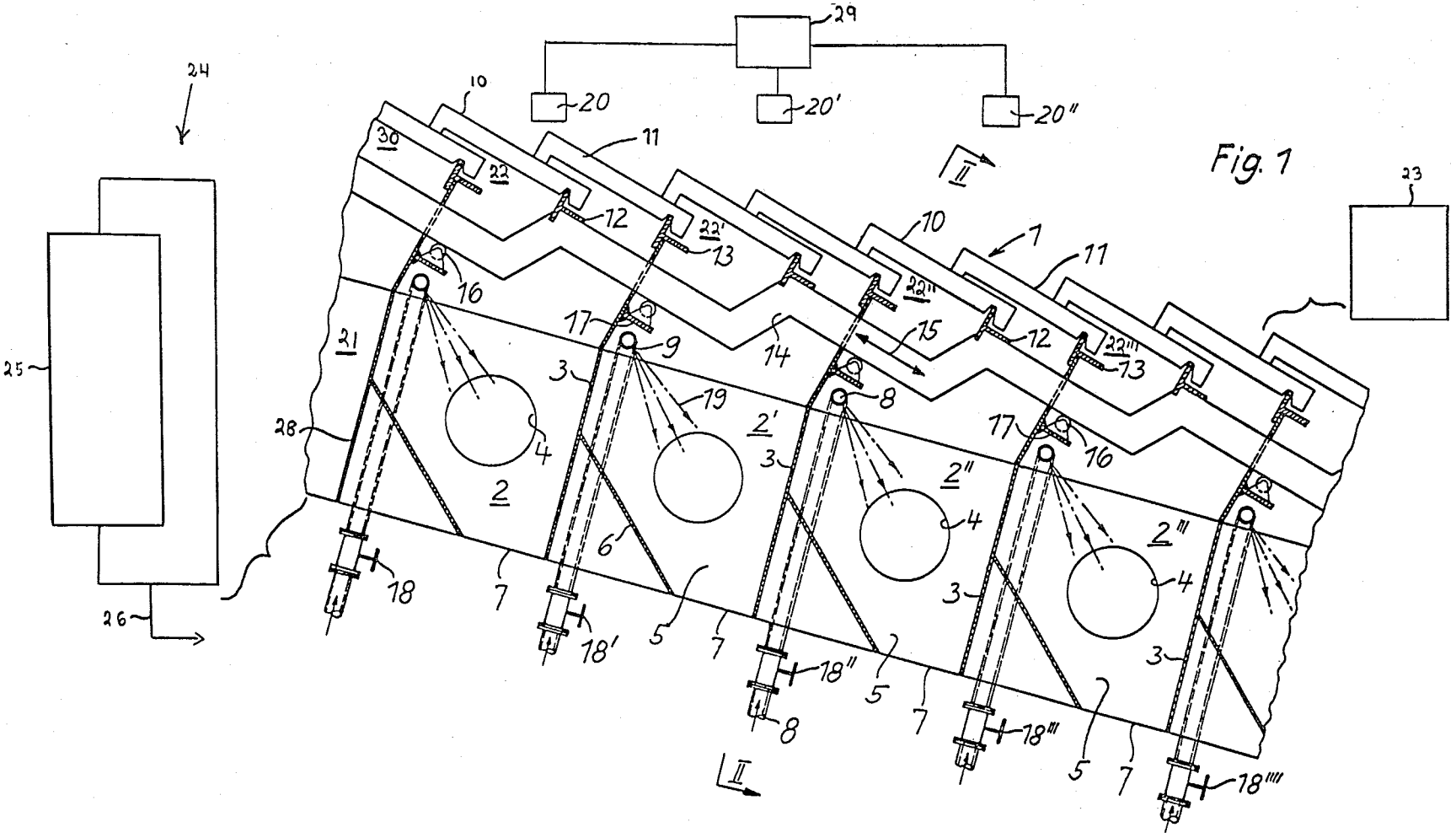
FIG. 1 is a longitudinal section through a portion of a combustion apparatus in accordance with the invention.
Figure 2:
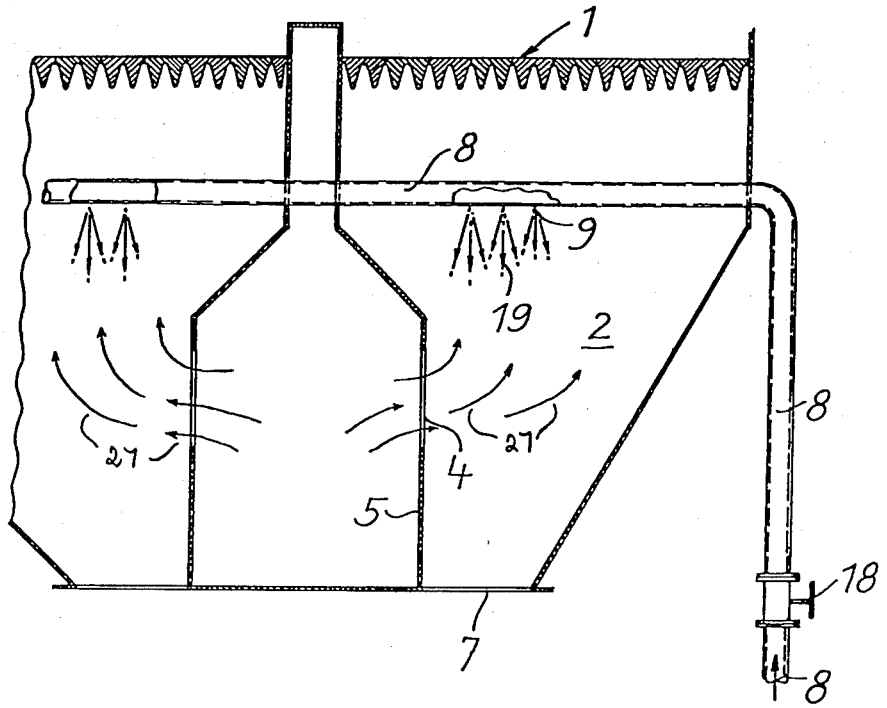
FIG. 2 is a view in the direction of the arrows II—II of FIG. 1.

The combustion apparatus of the invention illustrated in FIGS. 1 and 2 is here assumed to be a forced-draft furnace having a reciprocating grate 1 located in a combustion chamber 20.

The grate 1, which is of known construction, is made up of individual sections 10 and 11. Each of the grate sections 10 and 11 is constituted by a plurality of inclined bars arranged next to one another. The lower ends of the bars of the grate section 10 rest on movable supports 12 while the lower ends of the bars of the grate section 11 rest on stationary supports 13. The movable supports 12 are arranged on a zigzag-shaped beam 14 which can be moved back-and-forth along the direction indicated by the double-headed arrow 15. The beam 14 rests on rolls 16 which are carried by a support frame 28 for the grate 1.

As best seen in FIG. 1, a forced-draft mixing chamber 21 is arranged below the grate 1 and combustion chamber 30. The mixing chamber 21 is divided into several mixing zones 2, 2′, 2″, 2‴ which are separated from one another by dividing walls 3. Each of the mixing zones 2-2‴ communicates with a corresponding combustion zone 22, 22′, 22″, 22‴ in the combustion chamber 30.

An inclined plate 6 is located in each of the mixing zones 2-2‴. The plates 6 function to direct ashes which fall through the grate 1 to discharge openings 7 in the respective mixing zones 2-2‴ and thereby facilitate removal of the ashes from the mixing zones 2-2‴.

The furnace has a side wall 5 which is provided with a large opening 4 in each of the mixing zones 2-2‴. The air required for combustion is introduced into the mixing zones 2-2‴ via the openings 4 and then travels upwards to the combustion zones 22-22‴. The combustion air is supplied from a suitable source 23.

Pipes 8 for the supply of water vapor to the mixing zones 2-2‴ are arranged in the respective mixing zones 2-2‴. The pipes 8 communicate with a source of water vapor which is here assumed to be a closed steam-generating system 24. The system 24, which includes a boiler 25, is connected with the furnace. A take-off pipe 26 communicates with the system 24 and serves to convey waste steam from the system 24 to the pipes 8.

The pipes 8 have outlet openings or nozzles 9 in the mixing zones 2-2‴. As best seen in FIG. 2, the openings 9 are oriented in such a fashion that the water vapor enters the mixing zones 2-2‴ in an almost precisely vertical, downward direction as illustrated by the dash-and-dot arrows 19. The water vapor is directed into the midst of the combustion air flowing out of the openings 4. Since the combustion air flowing out of the openings 4 has both horizontal and vertical components of movement as is apparent from the full arrows 27 denoting the flow of combustion air into and through the mixing zones 2-2‴, the water vapor and combustion air flow partly countercurrent to one another and partly transverse to one another. The combustion air distributes itself in the mixing zones 2-2‴, entrains water vapor and then flows upwards into the combustion zones 22-22‴.

FIG. 1 shows that the support frame 28 for the grate 1 is provided with ledges 17 which are arranged above the water vapor pipes 8. The ledges 17 shield the pipes 8 from ashes which fall through the grate 1 and are capable of clogging the openings 9 of the pipes 8.

The supply of water vapor is regulated individually for each of the mixing zones 2-2‴. This may be accomplished, for example, via an appropriate number of valves 18, 18′, 18″, 18‴, 18⁗ which depends upon the length of the combustion chamber 30. Adjustment of the amount of water vapor supplied to the mixing zones 2-2‴ is advantageously performed sequentially.

Water vapor is admitted into each of the mixing zones 2-2‴ in an amount which is related to the $NO_x$ concentration of the waste gases generated in the corresponding combustion zone 22-22‴. The $NO_x$ concentrations may be measured by means of sensors 20, 20′, 20″ which may, for instance, be in the form of sampling sensors connected with a gas chromatograph which is common to all of the sensors 20-20′. The valves 18-18⁗, and thus the amounts of water vapor supplied to the various mixing zones 2-2‴, are regulated by the sensors 20-20′ via an appropriate valve-regulating mechanism 29. Although it will be understood that it is possible to use a single sensor, more precise regulation of the water vapor supply is achieved when several sensors are used.

The sensors 20-20′ may be arranged for individual and sequential analysis of the samples obtained thereby and corresponding activation of the valve-regulating mechanism 29. Thus, by way of example, the sensors 20-20′ may be arranged such that the sensor 20 is activated and causes the valves 18 and 18′ to open when the $NO_x$ concentration in the upstream region of the combustion chamber 40, that is, in the combustion zones 22 and 22′, reaches an unacceptable or harmful value. If the unacceptable concentration of $NO_x$ now spreads further along the length of the combustion chamber 30, the sensor 20' may effect the additional opening of the valve 18'' and so forth. On the other hand, when the combustion moderates and a reduction in the generation of harmful combustion gases occurs, the appropriate one of the sensors 20-20' can cause the corresponding valve or valves 18-18'''' to be throttled or closed.

The supply of water vapor directly into the region of combustion has the great advantage that, beginning in the early stages of combustion, the combustion region is inhibited from attaining temperatures which strongly promote the formation of $NO_x$.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of reducing $NO_x$ emissions from combustion apparatus, particularly furnaces, comprising the steps of:

(a) establishing combustion in a combustion chamber of the type having a plurality of combustion zones and mixing zones wherein each of said mixing zones communicates with a respective combustion zone, said mixing zones being located below said combustion zones;

(e) introducing into each of said mixing zones a combination of steam, a portion of which having been generated in a closed steam system, and combustion air and mixing said combination, wherein said combustion air preheated by said steam is introduced in a generally clockwise direction to said steam in at least a portion of said mixing zones;

(c) admitting said mixed combination of steam and combustion air into each of said combustion zones;

(d) monitoring the $NO_x$ concentration of waste gases emitted from each of said combination zones; and (e) adjusting the amount of steam introduced into each of said mixing zones in relation to the $NO_x$ concentration of the waste gases emitted from its corresponding combustion zone.

2. A method as defined in claim 1, further comprising the steps of premixing said combustion air and steam in mixing zones communicating with respective ones of said combustion zones prior to entering the latter.

* * * * *